US005895068A

United States Patent [19]

Doyle

[11] Patent Number: 5,895,068

[45] Date of Patent: Apr. 13, 1999

[54] HARD BINDING FOR A SNOWBOARD

[76] Inventor: Fintan Doyle, P.O. Box 1773, Frisco, Colo. 80443

[21] Appl. No.: 08/900,081

[22] Filed: Jul. 24, 1997

Related U.S. Application Data

[63] Continuation of application No. 08/391,718, Feb. 21, 1995, abandoned.

[51] Int. Cl.[6] ..... A63C 9/00

[52] U.S. Cl. ..... 280/618; 280/14.2; 280/607

[58] Field of Search ..... 280/14.2, 607, 280/617, 618, 623, 625, 614, 615, 631

[56] References Cited

U.S. PATENT DOCUMENTS

| | | | |
|---|---|---|---|
| 2,955,300 | 10/1960 | Hedlund et al. | 280/618 |
| 3,797,839 | 3/1974 | Smolka et al. | 280/607 |
| 3,917,296 | 11/1975 | Gertsch et al. | 280/618 |
| 4,741,550 | 5/1988 | Dennis | 280/14.2 |
| 4,955,632 | 9/1990 | Prestipino Giarritta | 280/607 |
| 5,044,654 | 9/1991 | Meyer | 280/613 |
| 5,145,202 | 9/1992 | Miller | 280/613 |
| 5,172,924 | 12/1992 | Barci | 280/14.2 |
| 5,188,386 | 2/1993 | Schweizer | 280/607 |
| 5,236,216 | 8/1993 | Ratzek | 280/607 |
| 5,474,321 | 12/1995 | Pritz | 280/607 |
| 5,538,271 | 7/1996 | Abondance | 280/617 |
| 5,649,722 | 7/1997 | Champlin | 280/14.2 |

FOREIGN PATENT DOCUMENTS

| | | | |
|---|---|---|---|
| 270175 | 6/1988 | European Pat. Off. | 280/14.2 |
| 398794 | 11/1990 | European Pat. Off. | 280/14.2 |
| 4034099 | 8/1991 | Germany | 280/14.2 |
| 4209112 | 10/1992 | Germany | 280/14.2 |
| 684056 | 7/1994 | Switzerland | 280/617 |
| 94/21339 | 9/1994 | WIPO | 280/14.2 |

OTHER PUBLICATIONS

"Quatre Fixations de Surf", Ski Magazine, No. 88, Jan. 1989, p. 95.

*Primary Examiner*—Brian L. Johnson
*Assistant Examiner*—Frank Vanaman
*Attorney, Agent, or Firm*—Brenda L. Speer

[57] ABSTRACT

The binding features a riser 9 as shown in FIGS. 3, 4A and 4B. A thickness of riser 9 is of a measurement which will elevate base plate 2 above snowboard 4 sufficient to permit snowboard 4 to flex beneath and about base plate 2 without snowboard 4 top surface 6 contacting base plate 2 while a rider is maneuvering snowboard 4. Accordingly, the riser 9 of the binding minimizes, if not eliminates, the flattened apex of the flex arc of a snowboard which occurs with standard bindings, and, therefore, permits a rider to achieve a smoother ride and the more precise carves and turns which occur when the snowboard flexes along its complete and natural flex arc.

Bail 53 of the binding as shown in FIG. 7 is a rod which is "U" shaped. The "U" bends 41 at about a forty-five degree angle at a midpoint of each of a stem of the "U", as more clearly shown in side view in FIG. 7. The stems of bail 53 are, preferably, threaded to threadingly engage with threads of threaded hole 66 of lug 51. With such a bail 53 and lug 51 configuration, the stresses incurred during use of a snowboard are absorbed, dampened and withstood by a strong stress point of a lug 51 and bail 53 assembly of the binding.

4 Claims, 6 Drawing Sheets

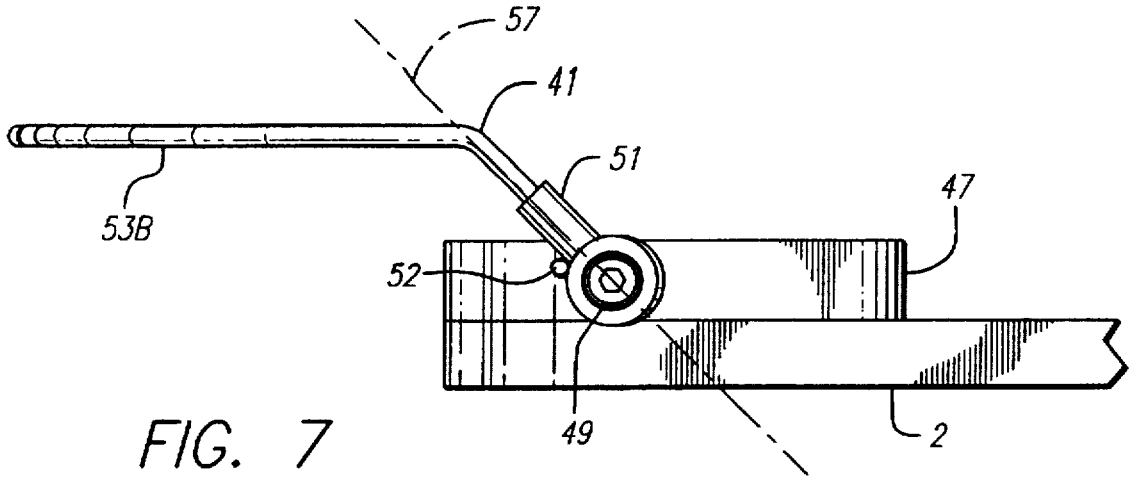
FIG. 7
FIG. 8
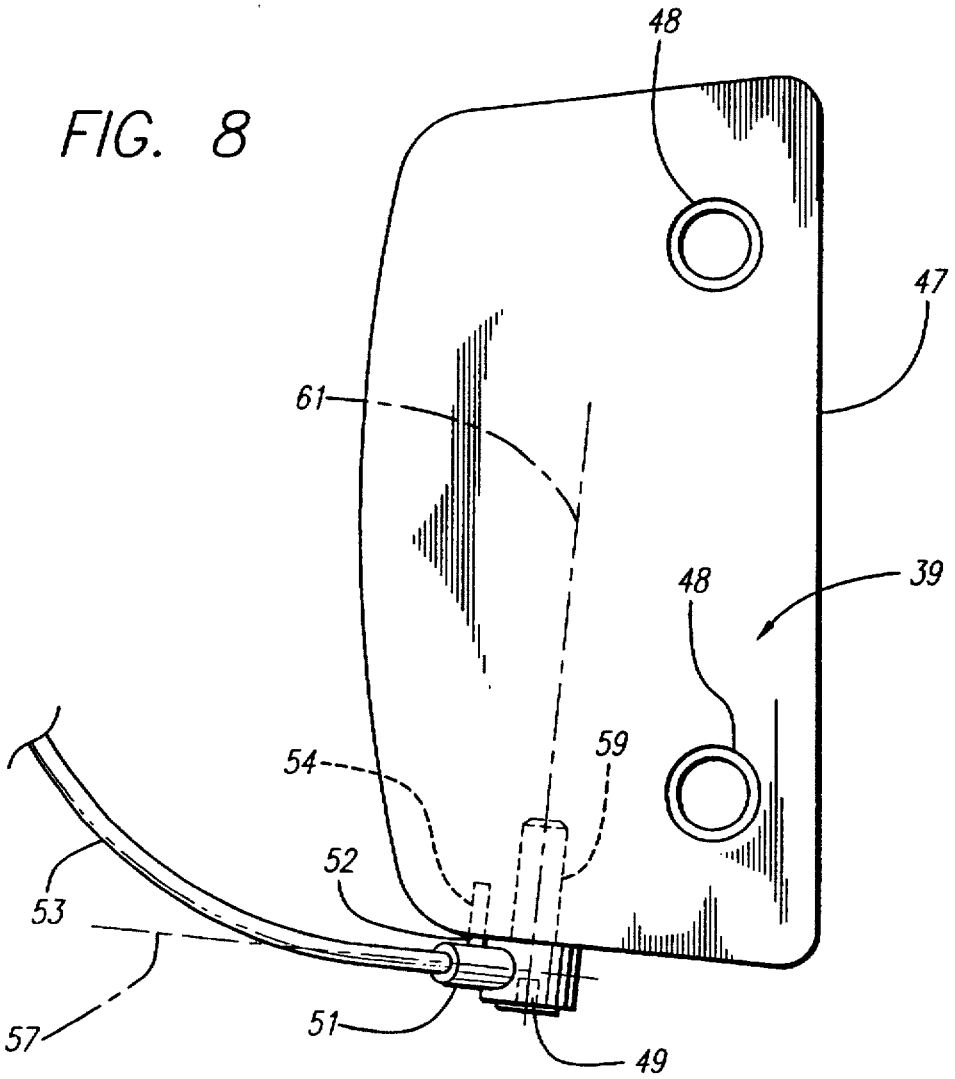

HARD BINDING FOR A SNOWBOARD

This application is a continuation of application No. 08/391,718 filed Feb. 21, 1995, now abandoned.

FIELD OF THE INVENTION

This invention relates to bindings for snowboards and, more particularly, to a hard binding for hard boot snowboarding.

BACKGROUND OF THE INVENTION

Snowboards are used for sports recreation, as well as competitive sport racing on snow covered downhill slopes. There are currently two versions of the sport of snowboarding, hard boot snowboarding and soft boot snowboarding. The invention relates to hard boot snowboarding.

Hard boot snowboarding uses a boot that has a standardized sole, similar to an alpine ski boot. The hard boot interacts with a snowboard by means of a plate binding. Standard plate bindings for snowboards consist of a base plate which has a surface area equal to or greater than the surface area of the hard boot sole. The binding is attached to the snowboard with its entire surface area flush with the top surface of the snowboard.

As a result of this large surface area contact of the binding with the snowboard, the ability of the snowboard to flex in the binding contact area is completely inhibited. Consequently, when the snowboard flexes, such as when a rider executes a carve turn, the arc of flex of the snowboard is not a true arc. Instead, the snowboard flexes in a partial arc wherein the apex of the arc is flattened in the area of the binding and snowboard contact. The inability of the snowboard to flex in a complete arc impacts the rider's ability to properly execute a carve turn, makes for a rough ride and reduces the rider's control over the snowboard. This flattened arc syndrome has been a problem for years, not only in the snowboard industry, but also in the alpine ski industry.

U.S. Pat. No. 5,172,924 by Barci for "Hard Shell Boot Snowboard Bindings and System", issued Dec. 22, 1992; and U.S. Pat. No. 5,236,216 by Ratzek for a "Binding for Snowboards", issued Aug. 17, 1993, both generally disclose a hard boot binding for a snowboard. Both of these bindings are flush mounted to a top surface of a snowboard by means of a base plate which has a surface area equal to or greater than a sole of a hard boot. The base plate is mounted upon a top surface of a snowboard and serves as a platform for attachment of various other binding parts. Such a flush mounting of a binding is not desirable, because, as previously mentioned, the snowboard is prohibited from flexing into a true arc. Rather, the apex of the flex arc of the snowboard is flattened in the area of the binding mounts. Therefore, the snowboard is unable to achieve its complete and natural flex arc during snowboarding maneuvers.

U.S. Pat. No. 5,188,386 by Schweizer for a "Binding Mounting Apparatus", issued Feb. 23, 1993, generally discloses an apparatus for a standard plate binding for attaching the binding to and adjusting the binding upon a snowboard. The binding provides a means by which to adjust the rotational angle and the cant angle of the binding relative to the top or mounting surface of the snowboard. Schweizer does describe a riser ring of rubber for adjusting the rotational and cant angles of the binding. However, as is evident from FIG. 1 of the Schweizer patent, the surface area of riser ring 25 is encompassed and exceeded by the surface area of the binding plate 22 (See also FIG. 12), as well as the adapter plate 45 (See FIGS. 10 and 11). Accordingly, a flattening of the flex arc of a snowboard on which the Schweizer binding was mounted would occur due to the large surface area coverage of the binding plate 22 and the adapter plate 45. Furthermore, in order for the Schweizer binding to perform in conjunction with the latest snowboards, the adapter plate 45 would have to be mounted beneath riser ring 50 (See FIG. 1), an embodiment preferred by Schweizer. Such a binding mount scheme would affect the flex arc of a snowboard, flattening the arc even more.

Another standard part which all standard plate bindings use are bails. The bails secure a snowboard hard boot within the binding. A typical plate binding has a front bail for securing the toe portion of a hard boot and a rear bail for securing the heel portion of a hard boot. Typically, a bail is "U" shaped with an inward facing, right angle projection at the end of each stem (hereinafter "stem ends") of the "U" for attaching the bail to a base plate of a snowboard binding. The bail is attached to the base plate by means of tension by stretching the bail and allowing the stem ends to snap into place in recesses within each side of the base plate. The bail stem ends are then typically secured within the base plate by means of an "e" clip or other suitable equivalent.

A considerable disadvantage of a standard bail is that it eventually breaks at the high stress point of the right angle of the stem end where the bail attaches to the binding. Each pair of bindings consists of four bails for a total of eight stem end right angles which will break. Because hard boot snowboarding is usually performed at a high rate of speed, considerable stress is placed upon the bails. Additionally, the probability is extremely high that a bail will break or fail while a snowboard is being ridden. When a bail breaks, the rider's boot is ejected from the binding and the rider will fall, creating a high likelihood of physical injury. Obviously, this inherent weakness of standard bails is very undesirable, disadvantageous and dangerous for riders who engage in hard boot snowboarding.

Other disadvantages of standard bails are that the length of the bail relative to the plate binding is not adjustable and the attachment of the stem end of the bail to the binding plate is not stable and secure and, consequently, the bail has much play in it. The inability of the standard bail to be adjusted and its insecure binding attachment prevents a rider from fine tuning the fit of the rider's hard boot within the binding. Therefore, the hard boot is not seated as securely within the binding as it could be, resulting in a loss of performance interaction between the boot, binding and snowboard, as well as an increase in the possibility of of the rider from the bindings with an attendant likelihood of physical injury. The inability to adjust the bails is further unfavorable considering all the different sizes and shapes of hard boots currently available. Every rider's performance and safety is compromised, because the rider is unable to achieve an optimum boot and binding fit.

U.S. Pat. No. 5,044,654 by Meyer for a "Plate Release Binding Winter Sports Device", issued Sep. 3, 1991; U.S. Pat. No. 4,955,632 by Prestipino Giarritta et al. for a "Safety Fastenings for 'Surf' Snowboards", issued Sep. 11, 1990; and U.S. Pat. No. 5,145,202 by Miller for a "Snowboard Release Binding", issued Sep. 8, 1992; all generally disclose a standard bail. As shown in FIGS. 10, 4 and 13, respectively, the bail is attached to the binding with a right angle bend at the point of insertion of the bail into the binding. Such an arrangement of the bail and binding is undesirable for all of the reasons previously stated, notably the high stress forces which occur at the right angle bail bend during use. This simplistic bending of the bail at a right angle and then inserting the bail into the binding is time and cost effective for a manufacturer, but extremely compromising of the performance and safety of a snowboard rider.

Obviously, there is a need in the hard binding snowboard industry for a binding with bails which can withstand the stresses placed upon the bails by a rider while snowboarding. Additionally, there is a need for a hard binding which will allow the snowboard to achieve its natural flex arc during maneuvers while being ridden by a rider.

SUMMARY OF THE INVENTION

The present invention discloses a hard binding for a snowboard which comprises a riser attached to a top surface of a snowboard; a base plate attached to the riser; sole plates attached to the base plate; and bails for securing a boot within the binding, the bails being attached to the sole plates.

The binding further comprises lugs which removably engage the bails, and which lugs removably attach to the sole plates. The rotation of the lugs about their attachment axis to the sole plates may be interrupted by a pin attached to the sole plates. Additionally, the lug of the binding of the present invention is able to withstand all stresses placed upon the bail during maneuvers so as to prevent failure of the bail.

The riser, the base plate, the sole plates, the bails and the lugs are attached to each other by means of a suitable fastener such as a threadingly engagable fastener. The preferred fastener is an Allen-head bolt.

The binding of the present invention is preferably made of a strong and rigid metal. Such a metal may be selected from the group consisting of aluminum, aluminum alloy, standard steel, stainless steel, titanium and titanium alloy.

In an alternative embodiment of the binding of the present invention, the riser may or may not be canted. Additionally, the riser may have a cavity within it, which may be either an indentation cavity or a through hole cavity.

The riser may have multiple sets of threaded holes which permit adjustment of the riser attachment position upon a snowboard. The base plate also may have corresponding through holes which permit adjustment of the base plate attachment position upon the riser. Additionally, the base plate may have multiple threaded holes which permit adjustment of the sole plates attachment positions upon the base plate.

Other attributes of the riser of the binding of the present invention are a vertical axis of the riser which is perpendicular to a top surface of the riser and wherein the threaded holes of the riser are parallel to the vertical axis of the riser. Also, the riser has a minimal diameter so as to permit the snowboard to achieve its complete and natural flex arc during manuevers by a rider.

BRIEF DESCRIPTION OF THE DRAWINGS

The present invention will be more readily understood by those of ordinary skill in the art upon reading the following detailed description of the invention in conjunction with a review of the appended drawings, in which:

FIG. 7 is a side view of a sole block of the binding.

FIG. 8 is a top view of a sole block of the binding.

DETAILED DESCRIPTION OF THE INVENTION

Figure 1:
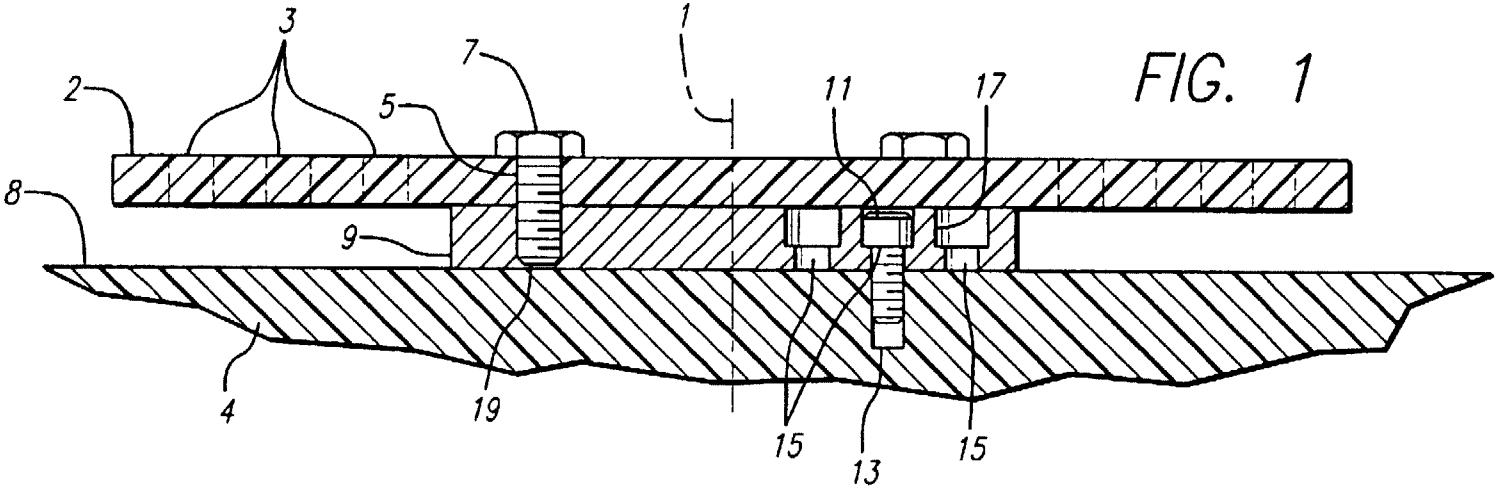
FIG. 1 is a fragmentary cross sectional side view of a partially assembled binding mounted upon a snowboard.

A standard hard binding for a snowboard consists of a base plate which is attached directly to a snowboard. A binding plate is then attached to the base plate. In contrast, the binding of the present invention has, as shown in FIG. 1, a base plate 2 and a riser 9, of which the riser 9 is mounted upon a snowboard 4. Riser 9 is attached directly to a top surface 6 of snowboard 4 by means of fasteners 11 which engage threaded holes 13 within snowboard 4. A base plate 2 is then attached to riser 9 by means of fasteners 7 which penetrate through holes 5 of base plate 2 and engage threaded holes 19 within riser 9. Preferred fasteners 7, 11 (and 45, 49 of FIG. 6) for use with the present invention are Allen-head bolts which greatly reduce or eliminate stripping. However, any other suitable fastener may be used such as a standard flat-head or Phillips-head screw or the like. Such a binding configuration results in base plate 2 being elevated above top surface 6 of snowboard 4 an amount equal to a thickness of riser 9.

Figure 2:
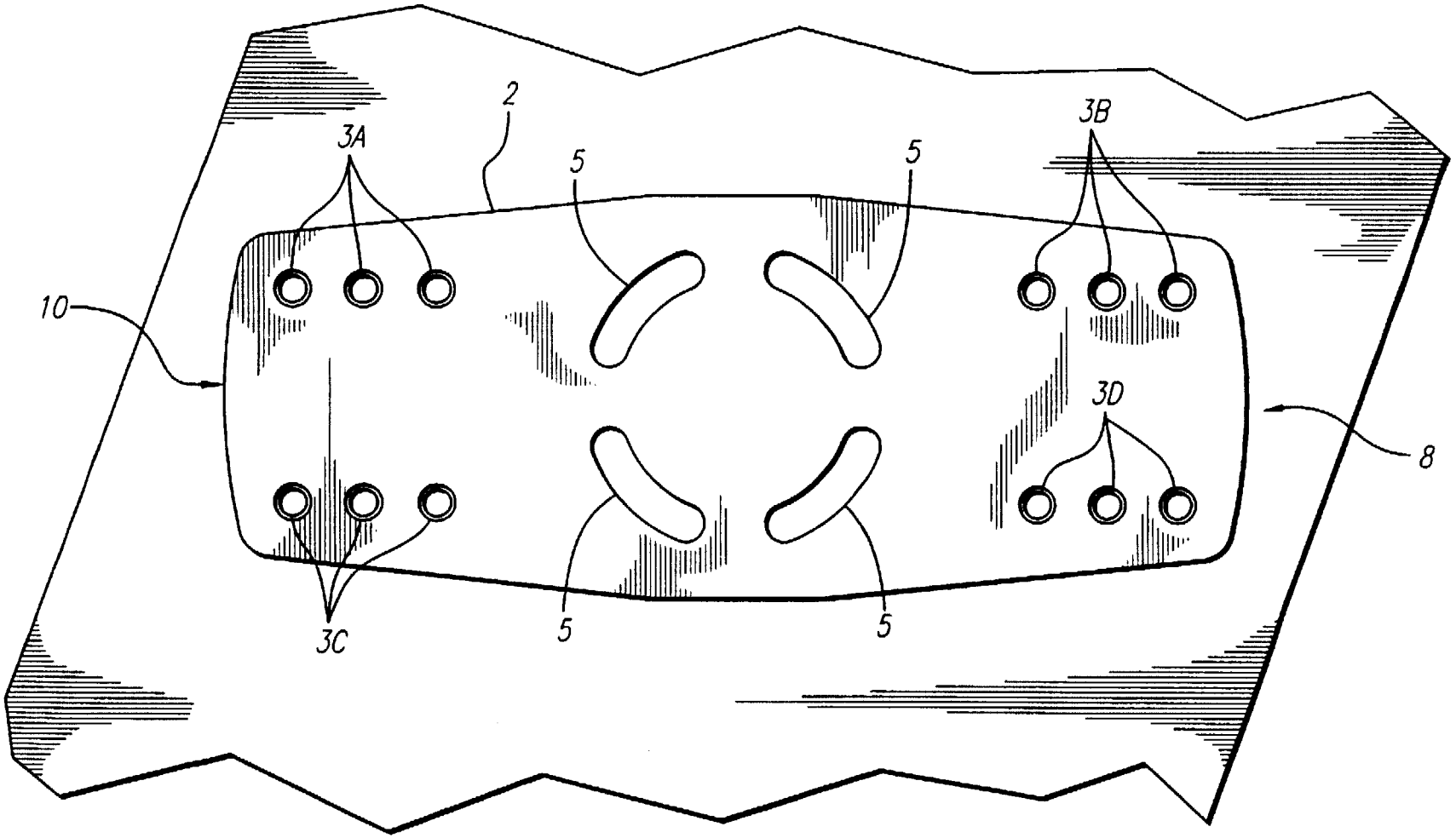
FIG. 2 is a fragmentary top plan view of a base plate of the binding situated upon a snowboard.

In FIG. 2, a base plate 2 as used in a binding of the present invention is shown. Base plate 2 is essentially flat and elongated with a middle portion of the base plate 2 being bowed such that the middle portion is wider than toe 8 and heel 10 sections of the base plate 2. Such a configuration is exemplary only and base plate 2 may have most any desired, suitable configuration.

Base plate 2 has within and perpendicularly through it four curved, elongated base plate through holes 5 which are arranged in a circular pattern about a mid-section of base plate 2. A diameter of the circular pattern of through holes 5 in comparison to a width of base plate 2, is such that a margin of from about 1 cm to about 2 cm exists between the side edge of holes 5 and the outer edge of base plate 2.

At each end of base plate 2 are threaded holes 3A, 3B, 3C, 3D, preferably a set of six holes 3B, 3D at a toe section 8 of base plate 2 and a set of six holes 3A, 3C at a heel section 10 of base plate 2. At the toe section 8 and the heel section 10 a block with a toe or heel bail, respectively, can be attached to base plate 2 by any suitable means, such as screw thread engagement.

Figure 4A:
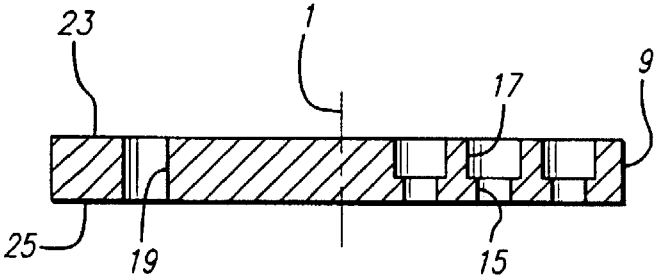
FIGS. 4A and 4B are both cross sectional side views of alternative embodiments of a level riser and a canted riser, respectively, of the binding.
Figure 4B:
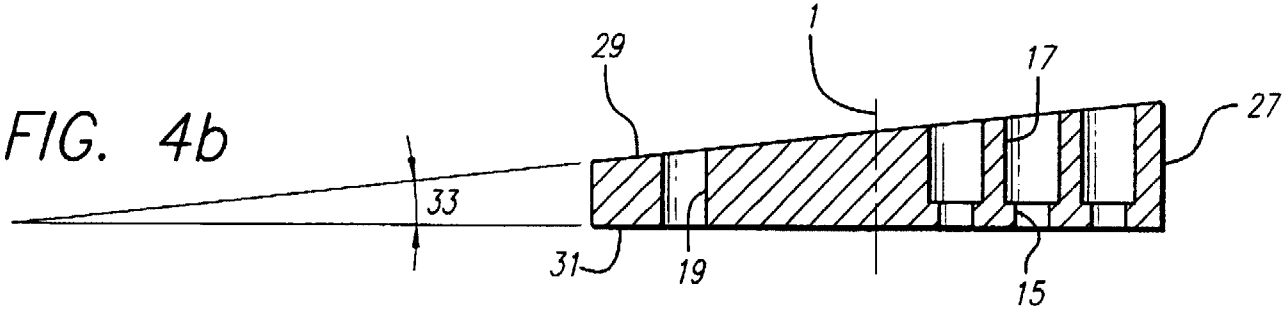
Figure 3:
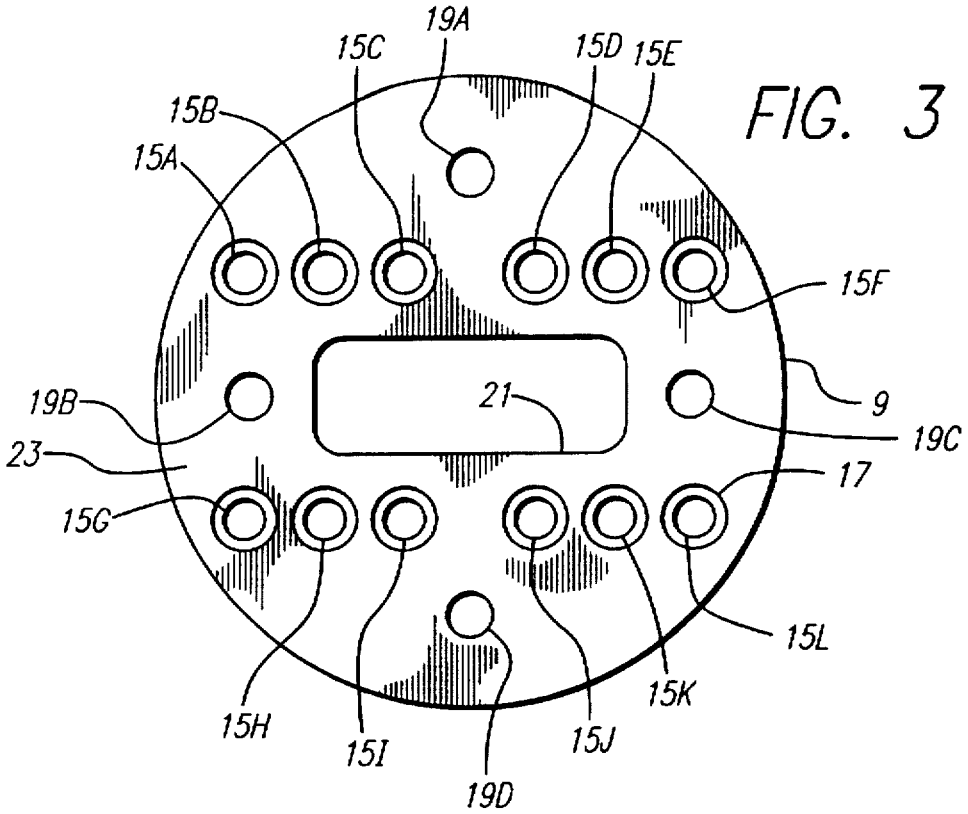
FIG. 3 is a top plan view of a riser of the binding.

An element unique to the binding of the present invention is a riser 9 as shown in FIGS. 3, 4A and 4B. Riser 9 in top plan view, such as in FIG. 3, may be of any symmetrical, geometric configuration, such as circular, triangular, square, rectangular or any other suitable symmetrical, geometric configuration. For the binding of the present invention, the preferred symmetrical, geometric configuration is circular.

A diameter of riser 9 preferably has a measurement which is the same as or less than a width of base plate 2. A thickness of riser 9 is of a measurement which will elevate base plate 2 above snowboard 4 sufficient to permit snowboard 4 to flex beneath and about base plate 2 without snowboard 4 top surface 6 contacting base plate 2 while a rider is maneuvering snowboard 4. A preferred elevation of base plate 2 above snowboard 4 is between about 0.5 and about 5.0 cm.

Figure 5A:
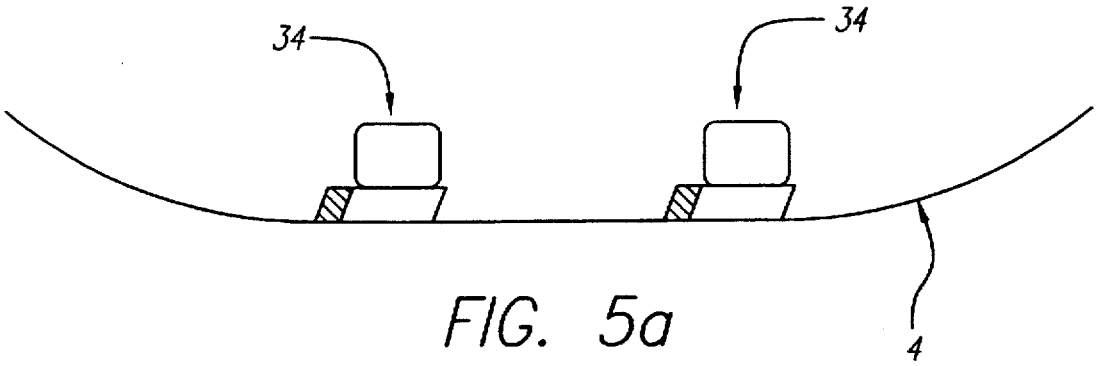
FIGS. 5A and 5B are side views of a standard binding mounted upon a snowboard and the binding of the invention mounted upon a snowboard, respectively, and the resulting flex arc of the snowboard when the snowboard is subjected to a flexing force.
Figure 5B:
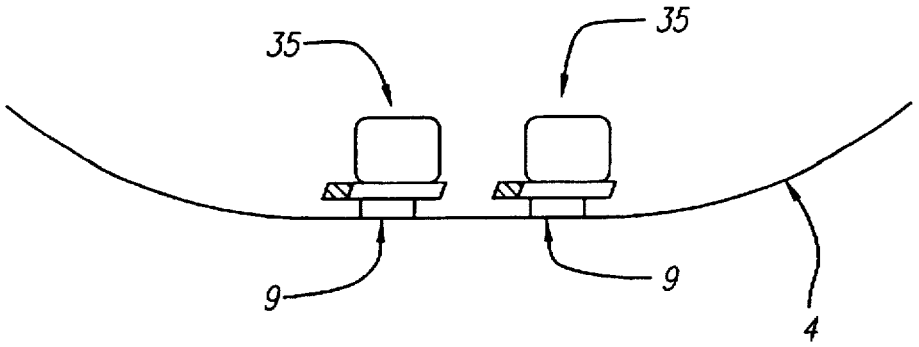

An average snowboard is about 150 cm in length, of which a standard snowboard binding covers two areas having a width of about 18 cm each, for a total of from about 36 cm to about 40 cm of the total snowboard length. Along the width of the binding attachment area to the snowboard, the snowboard is unable to flex along its full and natural flex arc. Consequently, a large area of the snowboard's flex arc is flattened, as more clearly shown in FIG. 5A. Such a large flattened area of the apex of the snowboard's flex arc prevents a rider from achieving even carves and turns.

Each riser 9 which is attached to snowboard 4 has a width of about 9 cm. Therefore, in contrast to a standard binding, the binding of the present invention covers less than about 18 cm of the total snowboard length, which is less than or equal to about 50 percent of the total area and length of the snowboard which is covered by a standard binding. The riser 9 of the binding of the present invention minimizes, if not eliminates, the flattened apex of the flex arc of a snowboard which occurs with standard bindings, and, therefore, permits a rider to achieve a smoother ride and the more precise carves and turns which occur when the snowboard flexes along its complete and natural flex arc.

As shown in FIG. 3, riser 9 has four threaded riser holes 19A, 19B, 19C, 19D which are symmetrically arranged in a radial pattern which corresponds to the symmetrical radial pattern of base plate through holes 5. Each threaded hole 19 is perpendicular to top surface 23 of riser 9.

Within riser 9 there are also twelve through holes 15A, 15B, 15C, 15D, 15E, 15F, 15G, 15H, 15I, 15J, 15K, 15L, each of which is perpendicular to bottom surface 25 of riser 9 as shown in FIG. 4A. Through holes 15 in riser 9 receive fasteners 11, as shown in FIG. 1, to attach riser 9 to snowboard 4 by means of threaded holes 13 within snowboard 4. Also as shown in FIG. 4A, each through hole 15 has a counter bore 17 which allows fasteners 11 to seat below top surface 23 of riser 9 to prevent interference between riser 9 and base plate 2 when the binding of the present invention is fully assembled upon snowboard 4.

As shown in FIG. 3, through holes 15 within riser 9 are arranged into four sets of three through holes 15 each. Each set is arranged within riser 9 such that through holes 15 are linearly aligned with each other within a set and the four sets are aligned with each other along two parallel lines of two sets of three through holes 15 each. The four sets of through holes 15 are radially offset, preferably, about forty-five degrees from threaded holes 19.

For adjustment of the binding of the present invention along the longitudinal lines of snowboard 4, fasteners 11 can be removed and reinstalled into an alternate set of through holes 15. For instance, if a rider desires to move the binding of the present invention toward a front end of a snowboard, then the rider would use through holes 15C, 15F, 15I, 15L. Alternatively, if the rider desired to move the binding of the present invention toward a rear end of a snowboard, then the rider would use through holes 15A, 15D, 15G, 15J. If a rider so desires, a snowboard may be provided with a plurality of threaded holes 13 to permit a wide range of adjustment of the binding of the present invention along longitudinal lines of a snowboard.

It would be obvious to one of ordinary skill in the art that each set of through holes 15 in riser 9 could be elongated in shape such as through holes 5 in base plate 2. Either through hole 15 shape, or most any other through hole 15 shape, would be acceptable for use with the binding of the present invention.

An additional element of riser 9 may be central cavity 21 as shown in FIG. 3. Cavity 21 may be either an indentation within riser 9 or may be a through hole within riser 9. Preferably, cavity 21 is a through hole within riser 9. Cavity 21 assists with diminishing a total weight of riser 9 of the binding of the present invention.

To adjust a rotational angle of base plate 2 in relation to riser 9, fasteners 7 which attach base plate 2 to riser 9 may be loosened, whereupon base plate 2 may be rotated about axis 1 as shown in FIGS. 1, 4A, 4B, within a range permitted by through holes 5 of base plate 2, of from about 22° to about 68°. Once a desired rotational angle is achieved, fasteners 7 are re-tightened.

To achieve greater performance and control from a snowboard, it is desirable for riders to be able to vary a cant angle of a snowboard binding in relation to a top surface of a snowboard. More specifically, such an adjustment may be achieved by repositioning a base plate which is normally parallel with a top surface of a snowboard, so that the base plate sets upon the snowboard at a determined angle between a top surface of a snowboard and a bottom surface of a base plate. A desired cant angle usually lies along an arc of a right angle formed by a vertical axis of a binding and a horizontal axis of a snowboard. However, it would be obvious to one of ordinary skill in the art that alternate angle arcs may be used for determining a desired cant angle.

An alternative embodiment of the riser of the present invention is shown in FIG. 4B as a canted riser 27. Canted riser 27 resembles riser 9 of FIG. 4A; however, top surface 23 plane of riser 9 is parallel with bottom surface 25 plane as shown in FIG. 4A. In contrast, top surface 29 plane of canted riser 27 in FIG. 4B forms an angle 33 with bottom surface 31 plane of canted riser 27. Even though top and bottom surface planes of a riser of the binding of the present invention may form an angle with regard to one another, vertical binding axis 1 will always maintain a perpendicular orientation with regard to top surface 23, 29. Accordingly, so that base plate 2 may rotate about axis 1 with a bottom surface plane of base plate 2 remaining parallel with a top surface 23, 29 of riser 9, 27, respectively, threaded holes 19 must be perpendicular to top surface 23, 29 of riser 9, 27.

As would be obvious to one of ordinary skill in the art, cant riser 27 may be manufactured so as to provide a myriad of cant angles. Suggested cant angles of cant riser 27 are 0° (for example, riser 9 of the binding of the present invention), 3°, 6°, and 9°. It would also be obvious to one of ordinary skill in the art that threaded holes 19 within riser 9, 27 may be of any suitable hole pattern and may comprise any suitable number of threaded holes 19.

Figure 6:
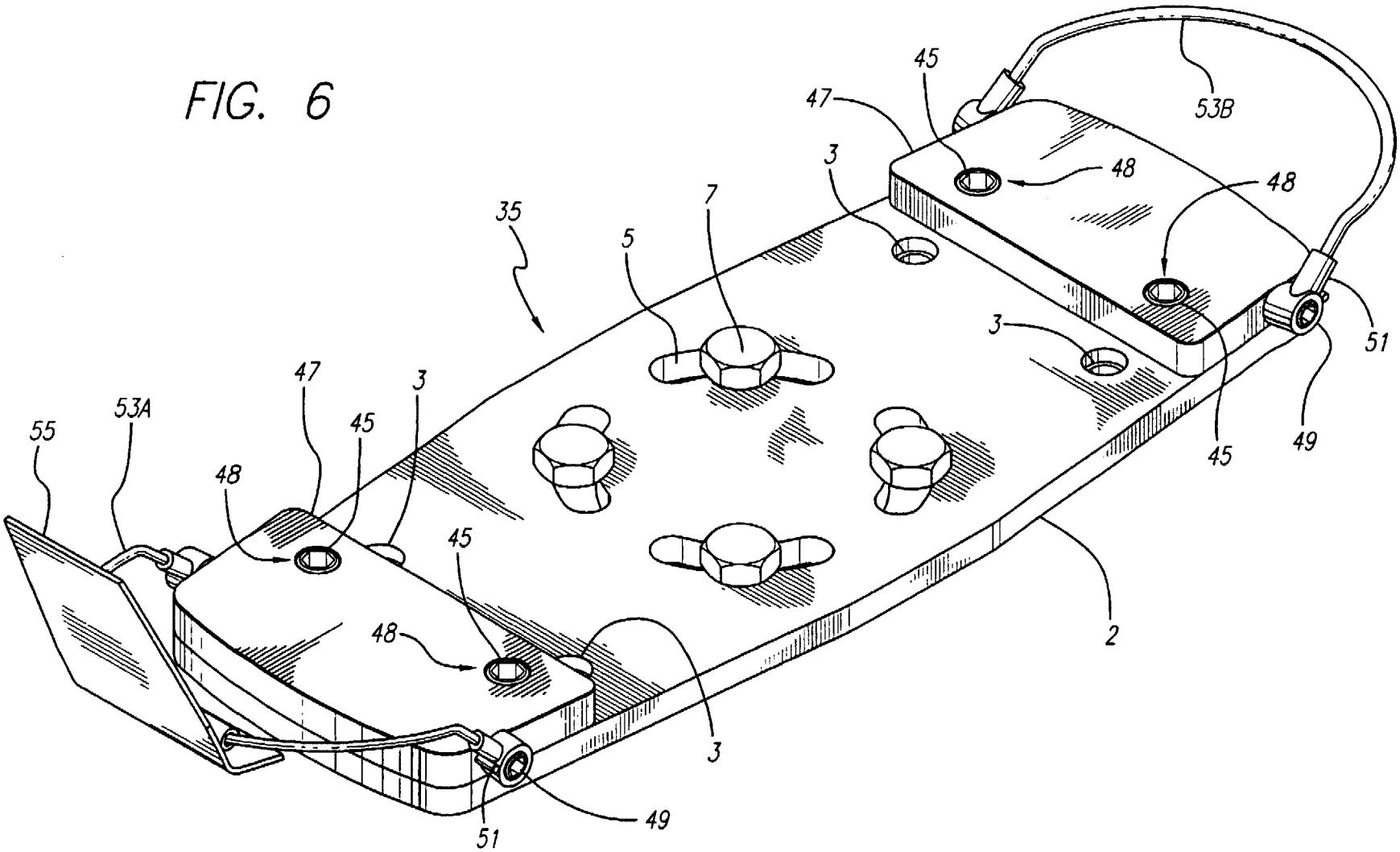
FIG. 6 is a perspective view of a base plate with attached bails of the binding.

As shown in FIG. 6, at each end of base plate 2 is a plurality of threaded holes 3 where sole blocks 47 are attached to base plate 2 by fasteners 45 which pass through through holes 48 and threadingly engage holes 3.

In FIGS. 6 and 8, sole block 47 has a preferred shape being a substantially square plate with one side of sole block 47 being rounded. As is obvious to one of ordinary skill in the art, any suitable shape for sole block 47 is acceptable. A threaded hole 59 is positioned on each of an opposing and a parallel side of sole block 47. The central passage of threaded hole 59 lies along axis 61 which is parallel to top surface 39 of sole block 47.

Figure 9:
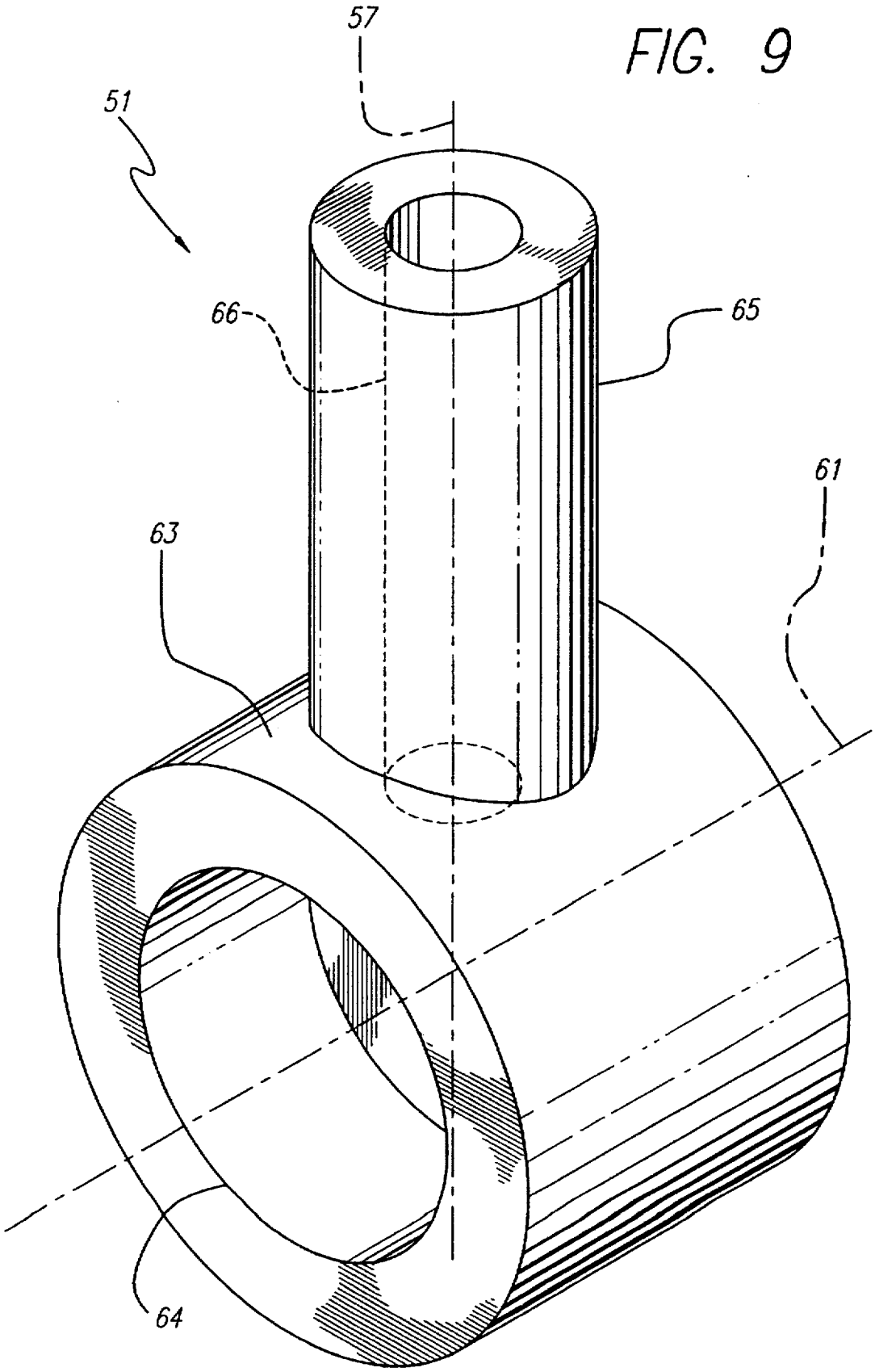
FIG. 9 is a perspective view of a lug of the binding.

FIG. 9 shows lug 51 of binding 35. Lug 51 may be a custom lug, or any other suitable lug. Lug 51 comprises a barrel 63 which has a through hole 64 whose central passage lies along axis 61. Extending from an outer surface of barrel 63 is projection 65. Within an entire length of projection 65 is threaded hole 66 which lies along axis 57, which axis 57 is perpendicular to axis 61.

Bail 53 as shown in FIG. 7 is a rod. Standard bail rods are about 5 mm in diameter. However, it is more preferable that bail rods used in the binding of the present invention be from about 6.0 mm to about 6.5 mm, and most preferable, from about 6.3 mm to about 6.4 mm. Bail 53 nestles around and engages a toe or a heel of a sole of a hard boot for a snowboard. Bail 53 is "U" shaped. The "U" bends 41 at about a forty-five degree angle at a midpoint of each of a stem of the "U", as more clearly shown in side view in FIG. 7. A tension lever 55 as shown in FIG. 6, is situated around a toe bail 53A for engaging and securing a toe of a hard boot for a snowboard into binding 35. Each stem of "U" shaped bail 53 must be of equal length and must be parallel to one another. The stems of bail 53 are, preferably, threaded to threadingly engage with threads of threaded hole 66 of lug 51.

Each threaded stem of bail 53 is threadingly engaged with a lug 51 as shown in FIGS. 7 and 8. In turn, in the preferred embodiment, each lug 51 is attached to sole block 47 by means of a shoulder bolt 49, or other suitable fastener, which passes through through hole 64 of lug 51 then threadingly engages threaded hole 59 of sole block 47. Shoulder bolt 49 permits bail 53, as engaged with lugs 51, to freely rotate about axis 61. With such a bail 53 and lug 51 configuration, the stresses incurred during use of a snowboard are not absorbed by a weak stress point of a right angle bail stem end attachment to a binding with the attendant disadvantages previously discussed, but rather are absorbed, dampened distributed and withstood by a strong stress point of a lug 51 and bail 53 assembly of the binding of the present invention.

As shown in FIGS. 7 and 8, a pin 52 is situated adjacent to lug 51. Pin 52 is secured to sole block 47 by means of a press fit into recess 54. Pin 52 is a limiter which interrupts the rotation of the bail 53 and lug 51 assembly about axis 61.

To adjust a length, and in turn a tension, of bail 53, shoulder bolts 49 or fastener means are removed from sole block 47. Each lug 51 is threadingly released from or further engaged with bail 53 by equal adjustments to extend or shorten the stem length of bail 53. When a desired stem length is achieved, lugs 51 are re-attached to sole block 47 by means of the shoulder bolts 49 or fastener.

Preferred materials for construction of the binding of the present invention are metals, such as aluminum, aluminum alloy, stainless steel, standard steel, titanium, titanium alloy and the like. Most preferred materials for the base plate 2 and risers 9, 27 are aluminum or aluminum alloy, because of their strength, rigidity, weight and cost. A most preferred material for fasteners 7, 11, 45, 49 and lugs 51 is stainless steel, because of its strength and corrosion resistance. A less preferable material for the base plate 2, risers 9, 27 and fasteners 7, 11, 45, 49 is standard steel, since standard steel is heavy and lacks corrosion resistance. Least preferable materials for the base plate 2, risers 9, 27 and fasteners 7, 11, 45, 49 are titanium and titanium alloy which are difficult to manufacture and cost prohibitive. Another least preferred material for the base plate 2, risers 9, 27 and fasteners 7, 11, 45, 49 is plastic, because it is weak and lacks sufficient rigidity. Accordingly, the base plate 2, risers 9, 27 and fasteners 7, 11, 45, 49 would require a large quantity of plastic in order for them to have the same strength achieved when they are made of aluminum, aluminum alloy, stainless steel, standard steel, titanium or titanium alloy. Additionally, the binding of the present invention would be cumbersome and heavy if it were to be constructed of plastic. Furthermore, threaded fasteners 7, 11, 45, 49 and threaded holes 13, 19 would deteriorate under use and strip such that they were no longer functional.

As would be obvious to one of ordinary skill in the art, the binding, particularly the riser 9, 27, is equally applicable to soft bindings for use with soft boot snowboarding and may be readily adapted for use with the same. In such an instance, base plate 2 of the present invention would be replaced with a soft binding base and fastening apparatus. A soft binding may use the riser 9, 27 of the binding for elevation of the soft binding above a top surface of a snowboard.

As would also be obvious to one of ordinary skill in the art, the binding of the present invention may be designed to be an automatically releasable or a non-automatically releasable binding. Furthermore, the binding incorporating riser 9 and bail 53 and lug 51 assembly could be applied to other sports in which a boot or a shoe is attached to equipment, for instance, alpine skis, cross-country skis, telemark skis, skate skis, snowshoes, ice-climbing crampons and the like.

The binding of the present invention allows for many advantages to the sport of snowboarding. The binding of the present invention does not break; provides secure boot and binding engagement with the snowboard, minimum play between boot and binding, and precise positioning of the binding upon a snowboard; allows the snowboard to achieve its natural flex arc and thereby affords a rider improved and precise carves and turns; reduces, if not eliminates, snowboard and binding inter-relational stresses; and permits the rider to adjust his boots to his liking because binding play is eliminated and no longer needs to be compensated for by boot adjustments.

The embodiments illustrated and discussed in the specification are intended only as exemplary and the many other feasible embodiments within the scope of this invention will be readily understood and appreciated by those having ordinary skill in the art. Nothing in the specification should be construed as limiting the scope of the invention. Many changes may be made by those having ordinary skill in the art to produce a highly effective hard binding for a snowboard without departing from the invention. Accordingly, the invention should be limited only by the claims.

I claim:

1. A snowboard binding comprising:

a. a base plate;

b. sole plates attached upon a top surface of the base plate; and c. bails, each end of a bail being attached to a sole plate with lug;

wherein the lug removably engages the bail along a longitudinal axis of a stem of the bail and a longitudinal axis of the lug, and the lug removably attaches to the sole plate along a latitudinal axis of the sole plate by means of a fastener which passes through an opening along the latitudinal axis of the lug and the fastener removably engages the sole plate along the latitudinal axis of the sole plate; further wherein the binding is not automatically releasable.

2. A snowboard binding comprising:

a. a riser which has a maximum length latitudinal axis equal to or less than a minimum length latitudinal axis of a base plate, a maximum length longitudinal axis less than a maximum length longitudinal axis of a base plate, and a surface area plane which does not protrude beyond a surface area plane of the base plate as the latitudinal axis of the riser and the latitudinal axis of the base plate are in superimposed alignment with each other and the longitudinal axis of the riser and the longitudinal axis of the base plate are in superimposed alignment with each other;

b. a base plate attached upon a top surface of the riser;

c. sole plates attached upon a top surface of the base plate; and d. bails, each end of a bail being attached to a sole plate with a lug;

wherein the lug removably engages the bail along a longitudinal axis of a stem of the bail and a longitudinal axis of the lug, and the lug removably attaches to the sole plate along a latitudinal axis of the sole plate by means of a fastener which passes through an opening along the latitudinal axis of the lug and the fastener removably engages the sole plate along the latitudinal axis of the sole plate; further wherein the binding is not automatically releasable.

3. A snowboard binding as claimed in claim 2, wherein the riser, as mounted upon a snowboard, has a thickness sufficient to permit the base plate to be elevated above a top surface of the snowboard a sufficient height to permit the snowboard to flex beneath and about the base plate without the top surface of the snowboard contacting the base plate while permitting the snowboard to achieve its complete and natural flex arc during maneuvers.

4. A snowboard binding as claimed in claim 3, wherein the riser has a thickness from about 0.5 cm to about 5.0 cm.

* * * * *